US007140678B1

(12) United States Patent
Grant

(10) Patent No.: US 7,140,678 B1
(45) Date of Patent: Nov. 28, 2006

(54) SCOOTER AND WHEELCHAIR HOOD

(76) Inventor: D'Shea Grant, 123-39 146th St., Jamaica, NY (US) 11436

( * ) Notice: Subject to any disclaimer, the term of this patent is extended or adjusted under 35 U.S.C. 154(b) by 0 days.

(21) Appl. No.: 11/205,914

(22) Filed: Aug. 17, 2005

(51) Int. Cl.
*E04H 15/06* (2006.01)

(52) U.S. Cl. ..... 297/184.15; 135/88.03; 135/96; 135/143

(58) Field of Classification Search ..... 297/184.1, 297/184.15; 135/88.03, 90, 96, 97, 117, 135/143, 88.04
See application file for complete search history.

(56) References Cited

U.S. PATENT DOCUMENTS 3,243,230 A * 3/1966 Otto ..... 297/184.15
4,201,416 A * 5/1980 Vanderminden ..... 297/184.15
4,687,249 A * 8/1987 Mills ..... 297/184.15
5,013,085 A * 5/1991 Craig ..... 297/184.15
5,168,889 A * 12/1992 Diestel ..... 297/184.15
D360,535 S * 7/1995 Sjoberg ..... D6/335
6,371,553 B1 * 4/2002 Tang ..... 297/184.1
6,789,557 B1 * 9/2004 Wahl, Jr. ..... 135/154
2006/0054207 A1 * 3/2006 Wootliff ..... 297/184.1

* cited by examiner

*Primary Examiner*—Peter R. Brown
(74) *Attorney, Agent, or Firm*—Goldstein Law Offices PC.

(57) ABSTRACT

A hood, for use with a wheelchair or scooter having a pair of vertical rails, a seat, and a seat back. The hood has a rear portion and a top portion hingeably connected to the rear portion with a transverse hinge. The top portion selectively extends perpendicular to the rear portion to extend over the seat for sheltering the person seated in seat, and selectively extends parallel to the rear portion so that the hood can lower behind the seat back for storage.

2 Claims, 4 Drawing Sheets

SCOOTER AND WHEELCHAIR HOOD

BACKGROUND OF THE INVENTION

The invention relates to a scooter and wheelchair hood. More particularly, the invention relates to a hood that attaches to a scooter or wheelchair, and is selectively extendible to shelter a person seated therein.

When seated in a scooter or wheelchair a person is substantially unprotected from sun and precipitation. For this reason, a standard umbrella is often used to provide shelter to the wheelchair occupant.

If the person seated in the wheelchair is propelling the wheelchair by himself, he does not have a free hand to hold an umbrella. In addition, if another person is pushing the wheelchair, it is not practical to let go of one of the handles to hold the umbrella.

Other devices have been proposed which provide shelter to a wheelchair or scooter occupant. While these units may be suitable for the particular purpose employed, or for general use, they would not be as suitable for the purposes of the present invention as disclosed hereafter.

SUMMARY OF THE INVENTION

It is an object of the invention to produce a hood, which effectively attaches to a wheelchair or scooter. Accordingly, the hood may be configured to attach to any existing wheelchair or scooter It is another object of the invention to provide a hood that effectively shelters the occupant of a wheelchair or scooter. Accordingly, the hood includes a top portion that substantially covers the seat to protect the occupant from sun and precipitation of all kinds.

It is a further object of the invention to provide a hood that is selectively retractable and stores compactly when not in use. Accordingly, the top portion of the hood is foldable and the rear portion may retract behind the wheelchair or scooter for storage.

The invention is a hood, for use with a wheelchair or scooter having a pair of vertical rails, a seat, and a seat back. The hood has a rear portion and a top portion hingeably connected to the rear portion with a transverse hinge. The top portion selectively extends perpendicular to the rear portion to extend over the seat for sheltering the person seated in seat, and selectively extends parallel to the rear portion so that the hood can lower behind the seat back for storage.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
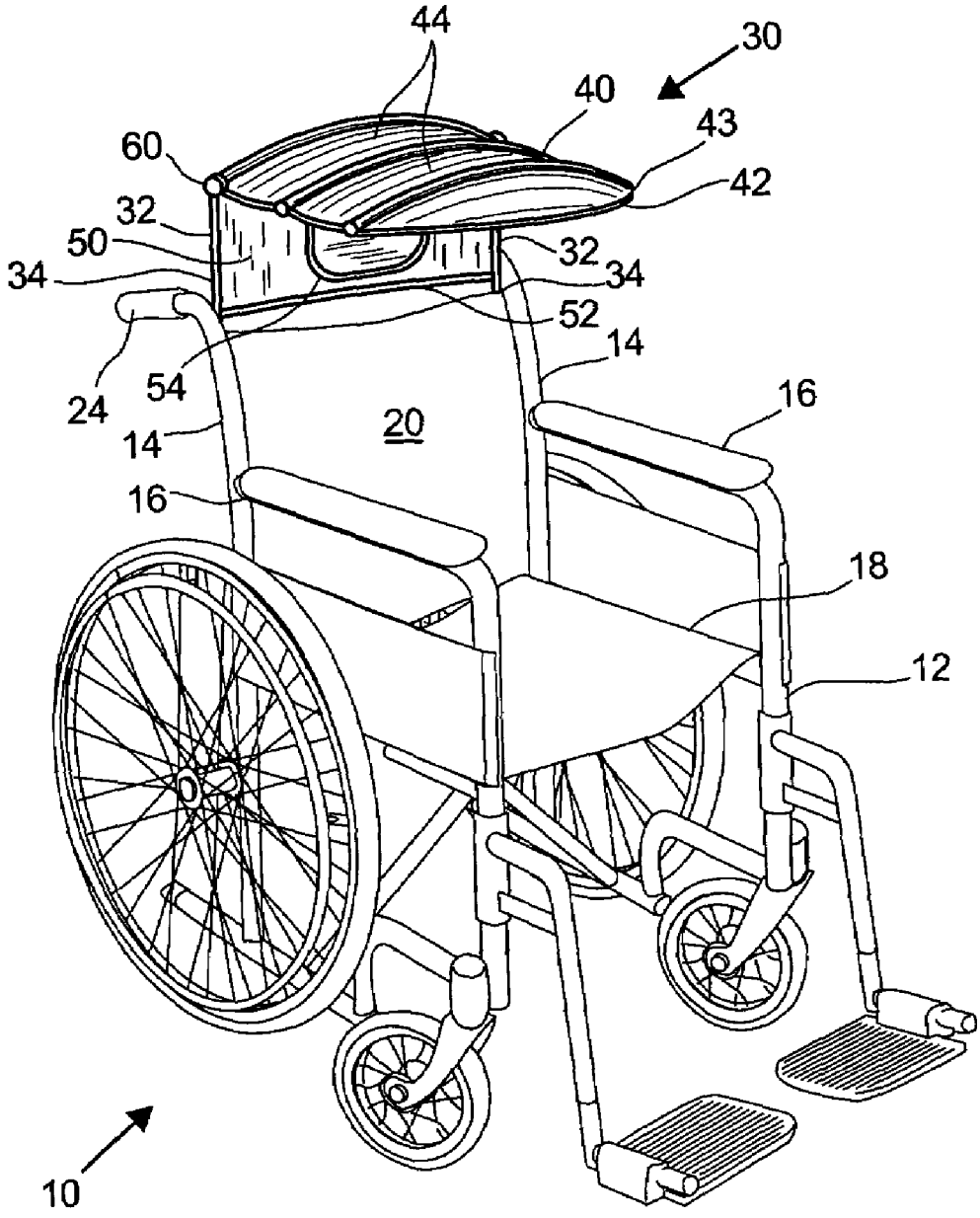
FIG. 1 is a diagrammatic perspective view, illustrating the present invention attached to a wheelchair, fully extended and ready for use.

FIG. 1 illustrates a wheelchair 10 having a frame 12, including a pair of vertical members 14, armrests 16, a seat 18 immediately in front of the vertical members 14, a seat back 20 spanning between the vertical members 14, and a pair of main wheels 22 attached to the frame 12. Each of the vertical members 14 has a handle 24 to allow the wheelchair 10 to be pushed by a person standing behind the wheelchair 10. For the purposes of the present invention, however, "wheelchair" is used throughout the following discussion for purposes of consistency of terminology. It should be understood, however, that the present invention can be readily adapted to work with a scooter as well.

In accordance with the principles of the present invention, a hood 30 is attached to the wheelchair 10. In particular, the hood 30 has a pair of side edges 32 and includes a top portion 40 and a rear portion 50. The top portion 40 and rear portion 50 meet at a transverse hinge 60. The top portion 40 includes a front edge 42, a bill 43 extending rearwardly from the front edge 42, and a plurality of folding sections 44 between the bill 43 and transverse hinge 60. The rear portion 50 includes a bottom edge 52 fully opposite from the transverse hinge 60. A window 54 is located on the rear portion 50 between the bottom edge 52 and the transverse hinge 60 and between the side edges 32. A pair of side bars 34 extend vertically along the side edges 32 and connect the hood 30 to the wheelchair 10.

Figure 2:
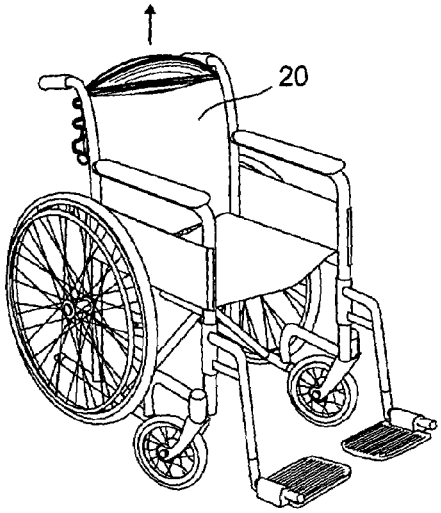
FIG. 2 is a diagrammatic perspective view, illustrating the present invention, fully retracted for storage.

Referring now to FIG. 2, the hood 30 is substantially concealed behind the seat back 20 of the wheelchair 10. In this storage position, the hood 30 may be effectively stored so that it does not impede the normal operation of the wheelchair.

Figure 3:
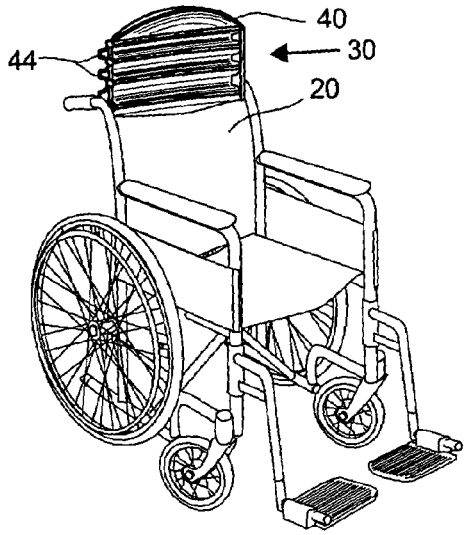
FIG. 3 is a diagrammatic perspective view, illustrating the present invention, partially deployed.

Referring to FIG. 3, the hood 30 has been lifted upwardly, so that the top portion 40 extends above the seat back 20. The top portion 40 is substantially folded, wherein the folding sections 44 are substantially compressed.

Figure 4:
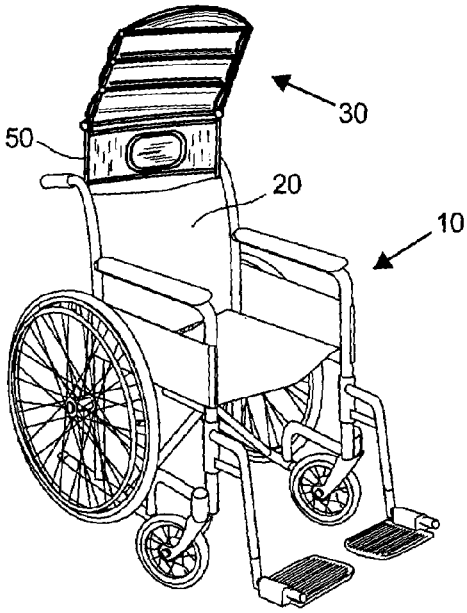
FIG. 4 is a diagrammatic perspective view, illustrating the present invention, similar to FIG. 3, except further deployed.

Referring now to FIG. 4, the hood 30 has been lifted further upwardly, so that the rear portion 50 also extends above the seat back 20. The top portion 40 and rear portion 50 extend substantially parallel to each other. It should be noted that is in this relative position between the top portion 40 and rear portion 50 that the hood 30 can be substantially stored behind the seat back 20 of the wheelchair 10.

Figure 5:
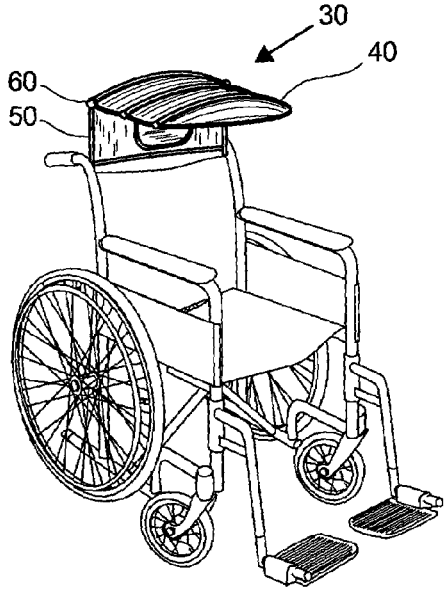
FIG. 5 is a diagrammatic perspective view, illustrating the present invention, simlar to FIG. 5, except wherein the present invention is fully deployed.

In FIG. 5, however, the top portion 40 has been pivoted about the transverse hinge 60 so that the top portion 40 now extends at a substantially ninety degree angle with respect to the rear portion 50. As illustrated in FIG. 5, this is the fully deployed position for the hood 30.

Figure 7:
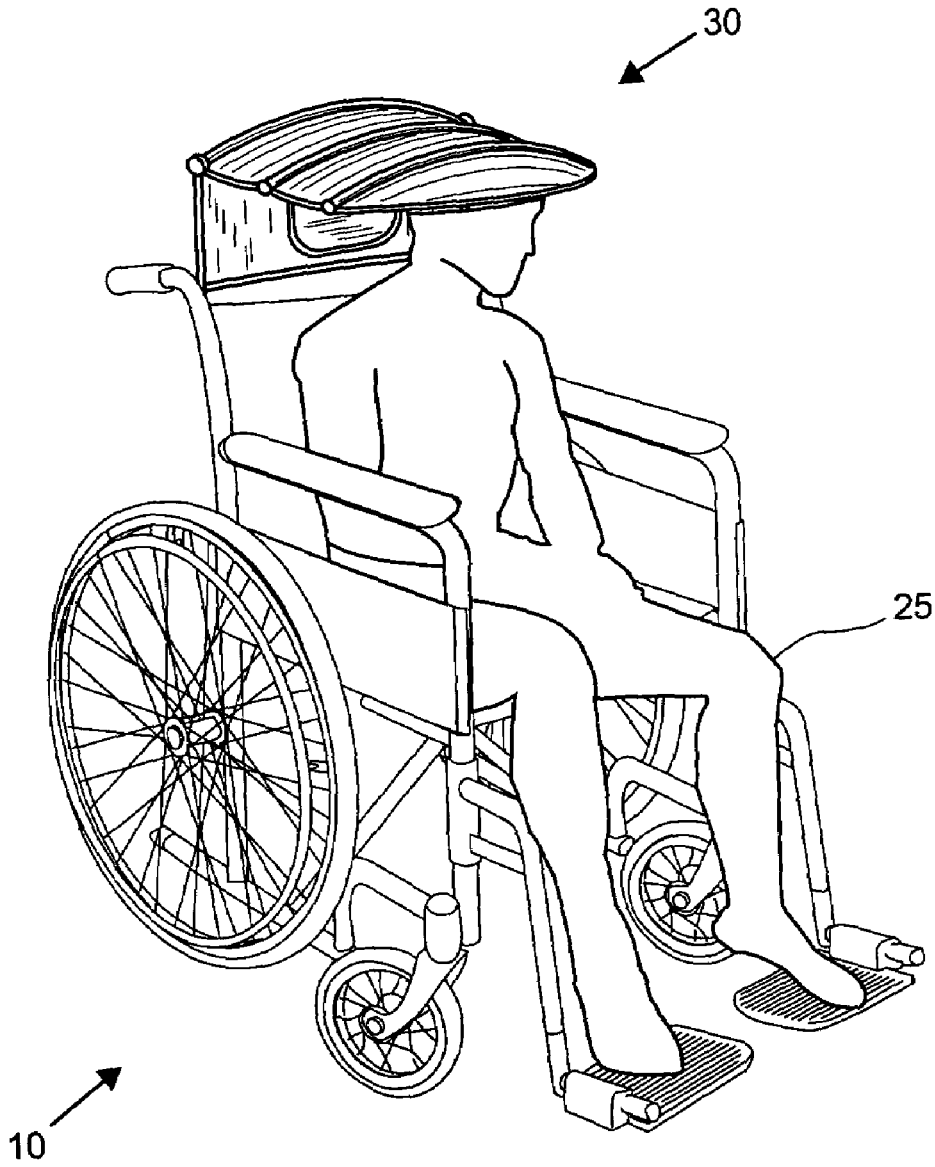
FIG. 7 is a diagrammatic perspective view, illustrating the invention in use, wherein a person is seated in the wheelchair and is being sheltered by the present invention.

Referring to FIG. 7, in the fully deployed position, the hood 30 can provide significant shelter to a person 25 that is seated in the wheelchair 10. The hood 30 can shelter the person from the sun and precipitation of all types.

Figure 6:
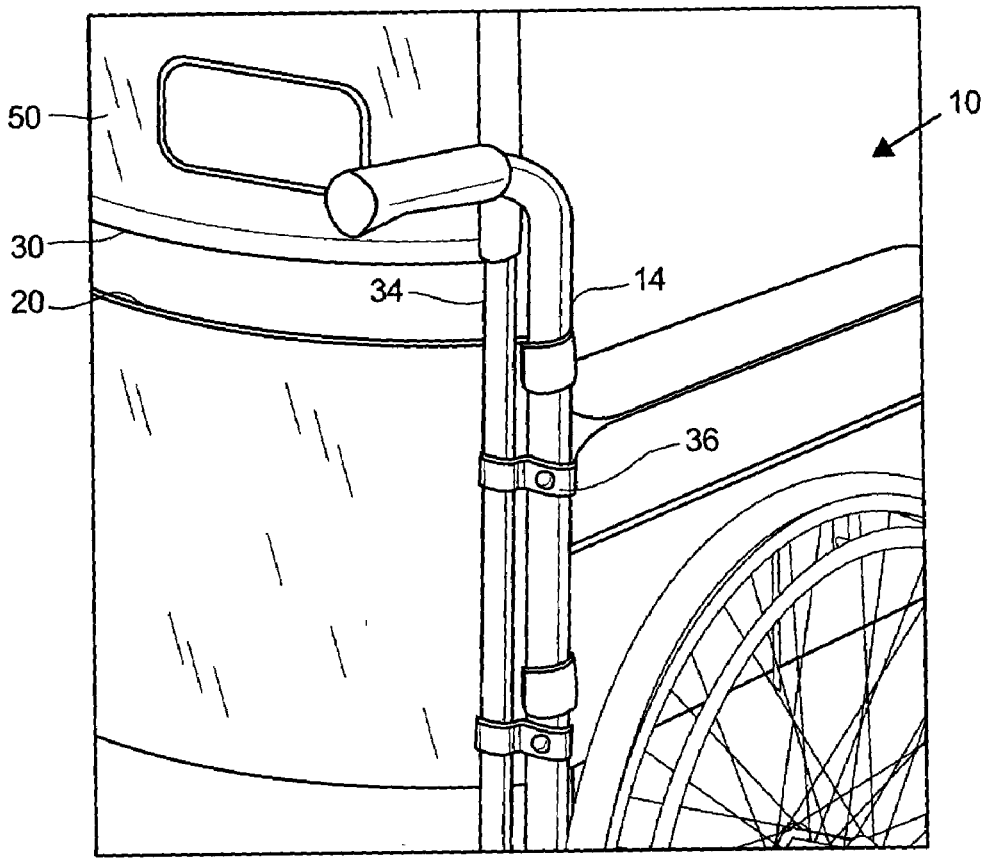
FIG. 6 is a diagrammatic perspective view, illustrating the rear of the wheelchair, with the invention attached thereat.

Referring now to FIG. 6, illustrated is an example of how the hood 30 can be attached to the wheelchair so as to allow the hood 30 to selectively extend over the seat to shelter a person seated in the wheelchair, and can selectively store behind the seat back 20. In the form illustrated, the side bars 34 extend downwardly behind the seat back 20, substantially parallel to the vertical members 14 of the wheelchair 14 and are coupled thereto such that the side bars 34 can selectively slide downwardly along the vertical members 14 to lower the rear portion 50 and top portion 40 of the hood 30 substantially behind the seat back 20 of the wheelchair 10. The connection between the side bars 34 and the vertical members 14 may include the use of sleeves 36 that are fixed to the vertical members 14 while allowing the side bars 34 to selectively slide therein so as to permit the height of the rear portion 50 of the hood to be easily adjusted by raising and lowering the side bars 34.

In conclusion, herein is presented a hood for use with a wheelchair or scooter for selectively allowing shelter to a person seated therein. The invention is illustrated by example in the drawing figures, and throughout the written description. It should be understood that numerous variations are possible, while adhering to the inventive concept. Such variations are contemplated as being a part of the present invention.

What is claimed is:

1. A hood, for use with a wheelchair having a pair of vertical members, a seat immediately in front of the vertical members, and a seat back, comprising:

a rear portion having a bottom edge and side edges and a window;

a top portion having a front edge and a bill adjacent to the front edge, and a plurality of folding sections;

a transverse hinge connecting the rear portion and top portion, the transverse hinge selectively allowing the top portion to extend parallel to the rear portion for storage and selectively allowing the top portion to extend perpendicular to the rear portion for extending over the seat of the wheelchair for sheltering a person seated in the wheelchair, wherein the folding sections of the top portion are between the bill and the transverse hinge; and a pair of side rails, attached along the side edges of the rear portion, the side rails adapted to be fixed to one of the vertical rails, for selectively lowering the rear portion and top portion behind the seat back for storage and for selectively raising the rear portion and top portion above the seat back for sheltering the person seated in the wheelchair.

2. The hood as recited in claim 1, further comprising a sleeve associated with each of the side rails, said sleeve adapted to be fixed to one of the vertical rails of the wheelchair and allowing the side rail associated with said sleeve to adjust vertically with respect to the vertical rails of the wheelchair.

* * * * *